US005575084A

United States Patent [19]

Vuorinen

[11] Patent Number: 5,575,084

[45] Date of Patent: Nov. 19, 1996

[54] METHOD AND DEVICE FOR DRYING OR COOLING A PAPER WEB

[75] Inventor: Vesa Vuorinen, Turku, Finland

[73] Assignee: Valmet Corporation, Helsinki, Finland

[21] Appl. No.: 476,644

[22] Filed: Jun. 7, 1995

[30] Foreign Application Priority Data

Jun. 23, 1994 [FI] Finland ..... 943040

[51] Int. Cl.[6] ..... F26B 13/18; F26B 13/20

[52] U.S. Cl. ..... 34/460; 34/448; 34/454

[58] Field of Search ..... 34/448, 452, 453, 34/454, 460, 462, 466

[56] References Cited

U.S. PATENT DOCUMENTS

| | | | |
|---|---|---|---|
| 3,057,079 | 10/1962 | Schmidt | 34/156 |
| 3,246,401 | 4/1966 | Walser et al. | 34/122 |
| 3,696,522 | 10/1972 | Krikorian | 34/115 |
| 4,137,644 | 2/1979 | Karlsson | 34/460 |
| 4,297,794 | 11/1981 | Luthi | 34/122 |
| 4,693,015 | 9/1987 | Hemsath et al. | 34/454 |
| 5,172,844 | 12/1992 | Mueller | 34/460 |
| 5,299,364 | 4/1994 | Heikkilä et al. | 34/460 |

FOREIGN PATENT DOCUMENTS

| | | |
|---|---|---|
| 712919 | 5/1972 | Finland . |
| 62573 | 2/1979 | Finland . |

*Primary Examiner*—Edward K. Look
*Assistant Examiner*—Michael S. Lee
*Attorney, Agent, or Firm*—Steinberg, Raskin & Davidson P.C.

[57] ABSTRACT

A method and device for drying and/or cooling a paper web or equivalent in which the web is passed over the circumference of a revolving roll on support of a face of a support wire that faces the roll. The web is dried and/or cooled by means of a gas blown through openings in the mantle of the roll into a space between the outer face of the roll and the web supported by the support wire, whereby a support zone formed by pressurized gas is formed between the outer face of the roll and the web. Humidified gas is passed out of the support zone into the interior of the roll through other openings in the mantle of the roll into a system of exhaust ducts placed inside the roll.

9 Claims, 19 Drawing Sheets

FIG. 1A
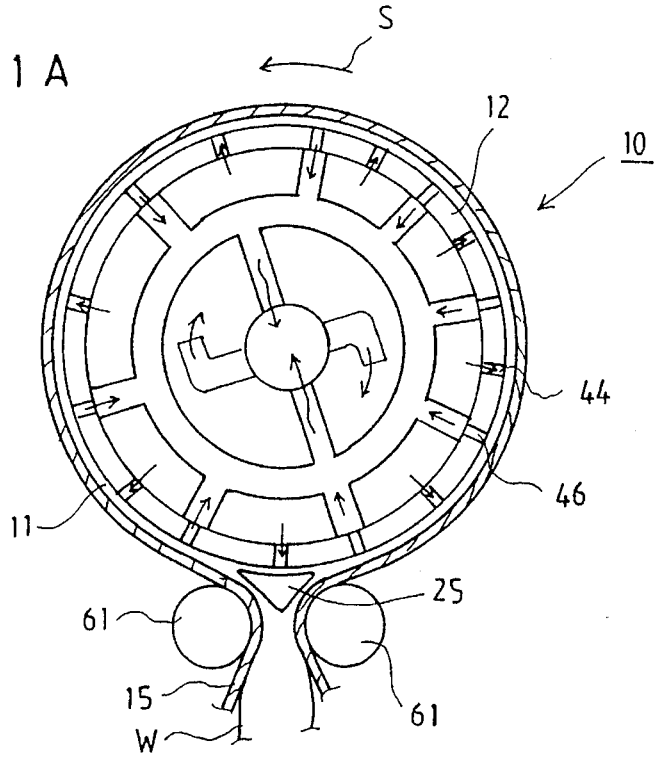
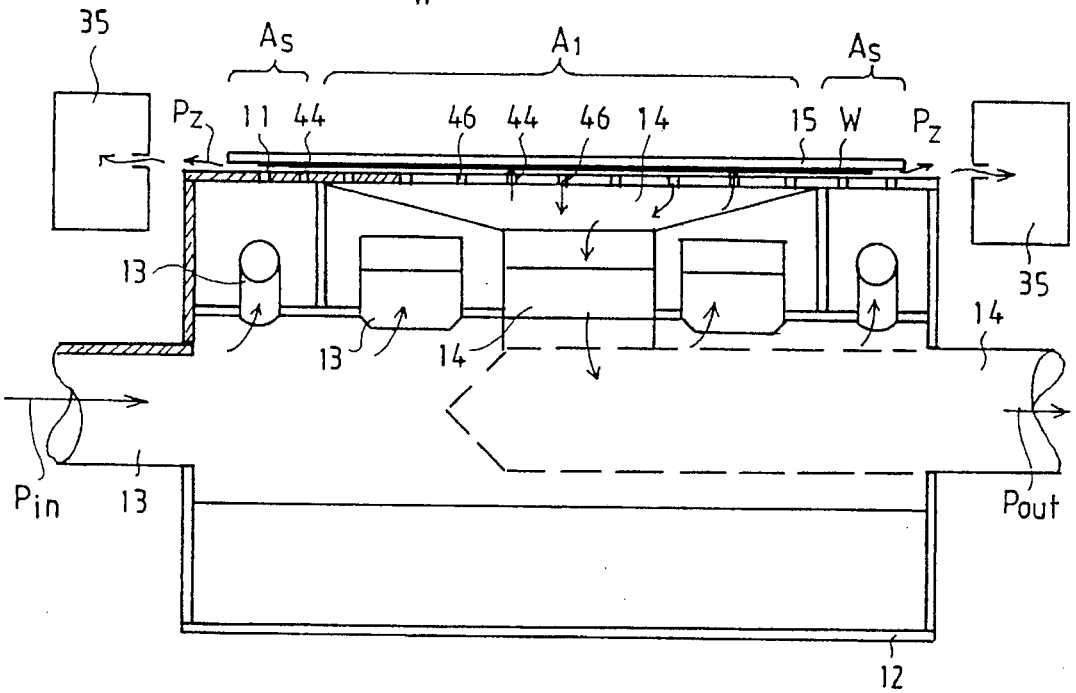
FIG. 1B

FIG. 4A
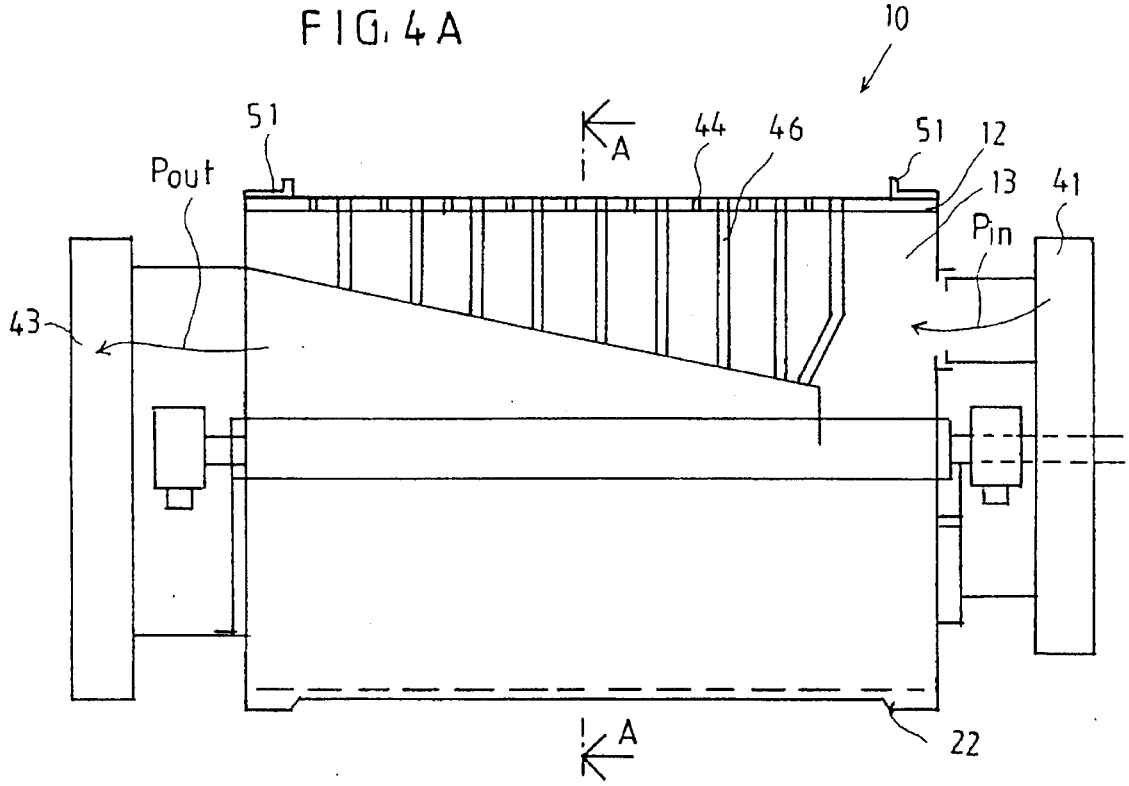
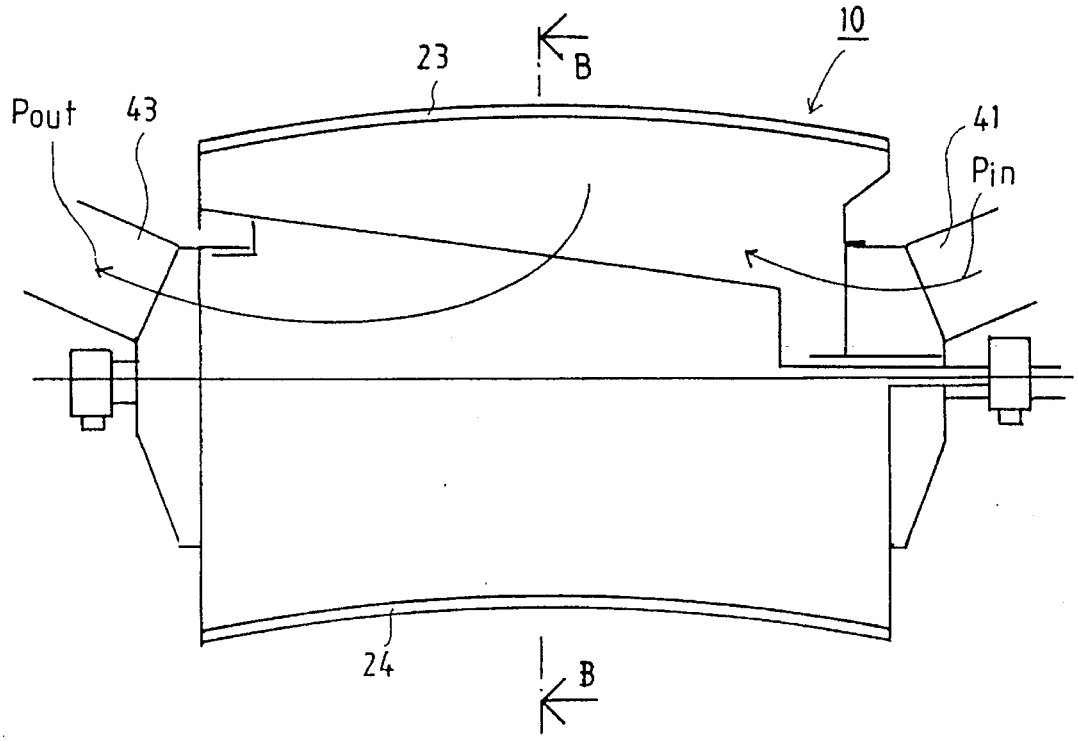
FIG. 4B

FIG. 11Q
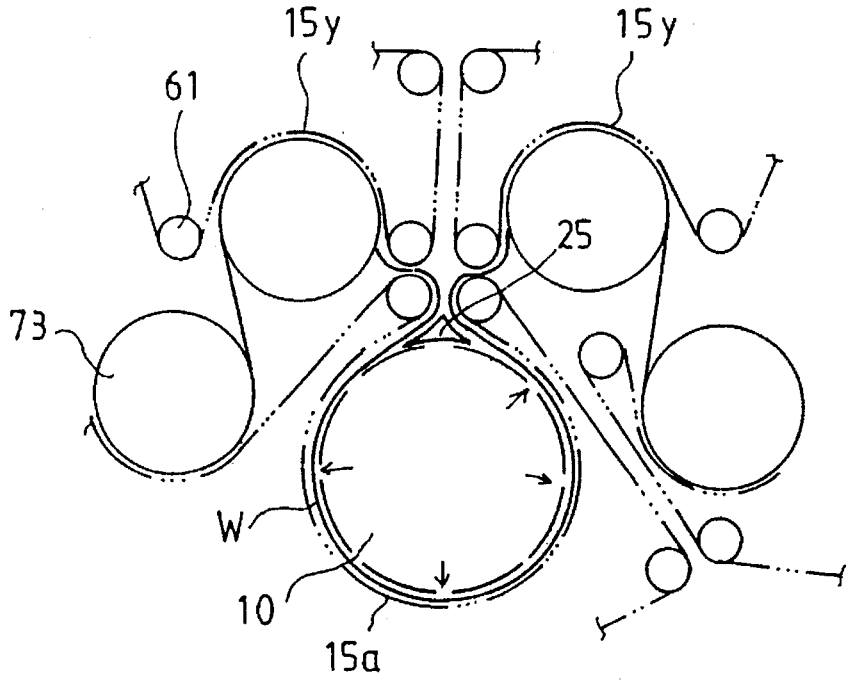
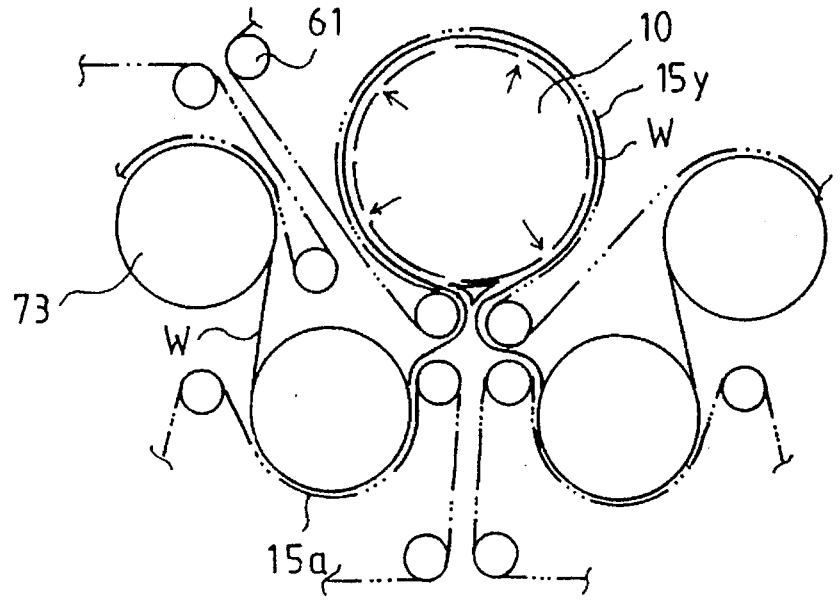
FIG. 11R

METHOD AND DEVICE FOR DRYING OR COOLING A PAPER WEB

BACKGROUND OF THE INVENTION

The present invention relates to a method for drying and/or cooling a paper web or equivalent in which the web is passed over the circumference of a revolving roll or equivalent on support of a face of a support wire or equivalent that faces the roll. The web is dried and/or cooled by means of a gas.

Further, the present invention relates to a device for drying and/or cooling of a paper web or equivalent, which comprises a revolving roll or equivalent provided with openings placed in the mantle thereof. In an interior of the roll, a system of gas ducts is formed, the web to be dried being arranged to run over the circumference of the roll preferably on support of a support wire or equivalent.

The highest web speeds in paper machines are currently of an order of about 25 meters per second, but before long, the speed range of from about 25 m/s to about 40 m/s is also likely to be realized. Even with the highest speeds that are employed now, and with the ever higher speeds in the future, the dryer section of a paper machine has especially become and will be a bottle-neck for the runnability of a paper machine.

In the prior art, in multi-cylinder dryers of paper machines, twin-wire draw and/or single-wire draw is/are employed. In the twin-wire draw, the groups of drying cylinders comprise two wires, which press the web, one from above and the other one from below, against the heated cylinder faces. Between the rows of cylinders, which are usually horizontal rows, the web has free and unsupported draws which are susceptible of fluttering, possibly resulting in web breaks. In the single-wire draw, each group of drying cylinders comprises only one drying wire on whose support the web runs through the whole group so that, on the drying cylinders, the drying wire presses the web against the heated cylinder faces, and on the reversing cylinders between the drying cylinders, the web remains at the side of the outside curve, i.e., the drying wire is between the web and the reversing cylinders. Thus, in single-wire draw, the drying cylinders are situated outside the wire loop, and the reversing cylinders are situated inside the loop. In the prior art normal groups with single-wire draw, the heated drying cylinders are placed in the upper row, and the reversing cylinders are placed in the lower row, the rows being generally substantially horizontal and parallel to one another. So-called inverted groups with single-wire draw are also known, in which the heated drying cylinders are placed in the lower row and the reversing suction cylinders or rolls in the upper row, the substantial objective being to dry the web from the side opposite in relation to a normal group with single-wire draw.

In the following, when the terms "normal (dryer) group" and "inverted (dryer) group" are used, what is meant is expressly the groups with single-wire draw similar to those mentioned above.

In the area of the dryer section of a paper machine, various problems have occurred, for which the present invention suggests novel efficient solutions.

These problems include the large length of the dryer section, which increases the costs of the dryer section and of the machine hall. Problems have also been caused by the difference in speed between the paper web and the wires, which has resulted in wear of the wires and, at the worst, even to paper breaks in the dryer section. Problems may also have occurred in the controllability of the web draw and in the runnability of the web.

With respect to the prior art, reference is made to Finnish Patent Application No. 2919/71 which describes a continuous dryer for paper products in which two cylinders with adjustable temperatures are used. The cylinders are placed at a short distance from one another on the joint portion of the runs of carrier belts penetrable by air. The belts are guided towards the starting point of their joint run by means of cylinders which blow hot air through their side walls and which cylinders have been called air-blow cylinders. In this prior art construction, heat is always transferred to the paper by the intermediate of a wire, in which case the wire that is employed must be capable of storing of heat. Further, the wire is penetrable by air, because the preheating takes place by the principle of blowing through the wire. It follows from this description that it is always necessary to use a woven metal wire. Also in this construction, the outlet gas is passed through the wire to outside the cylinder, and the paper is always carried between two wires. The construction of the blow cylinder in itself has not been described, but it has just been stated that, in the cylinders, an inside partition wall is employed.

With respect to the prior art, reference is also made to Finnish Laid-Open Publication No. 62,573, in which a dryer for drying a continuous paper-fibre sheet is described. In this dryer, there is a rotatable drum and means for feeding dry gas into the interior of this rotatable drum and means for making the gas to flow out of the rotatable drum. The material to be dried is not supported by a wire or equivalent and runs around the drum on support of strips. The drying gas spreads onto the face of the material to be dried along particular passages placed on the face of the drum, in which passages the gas can spread in the direction of the circumference only, because the strips for supporting the material to be dried separate the passages from one another. The trapeze-like strips parallel to the circumference intensify the flow of the drying gas in the direction parallel to the circumference. The gas distribution equipment is stationary, i.e., any leakage from the drying gas to the outlet gas take place inside the drum. This results in a certain percentage of loss of gas.

OBJECT AND SUMMARY OF THE INVENTION

It is an object of the present invention to provide a method and a device in drying of a paper web or equivalent in which method and device the problems described above have been eliminated or at least minimized.

In view of achieving the object stated above and others, in the method in accordance with the invention, drying and/or cooling gas is blown through openings present in, or formed into, the mantle of the roll into the space between the outer face of the roll and the web supported by the support wire or equivalent, whereby a support zone formed by pressurized gas is formed between the outer face of the roll and the web. The humidified gas is passed out of the support zone into the interior of the roll through other openings present in, or formed into, the mantle of the roll, into a system of exhaust ducts placed inside the roll.

In the method in accordance with the invention, drying gas is blown, through the openings in the roll mantle, between the outer face of the roll and the web supported by the support wire. An air cushion is formed between the outer face of the roll and the web, the counter-force required by the cushion being produced by using the tension force of the wire as an aid. The humidified gas is passed out of the air cushion into the roll interior through other openings in the outer circumference of the roll, into the system of exhaust ducts placed inside the roll.

In the device in accordance with the invention, blow openings are arranged in the roll mantle so as to form a support zone formed by pressurized gas between the outer face of the roll and the web to be dried. In the mantle of the roll, there is a second set of openings for removal of the humidified gas.

In the arrangement in accordance with the invention, the gas is blown directly against the material to be dried, and the exhaust gas is removed directly between the holes or slots. Owing to the unified construction of the roll or drum that forms the device, no gas is lost, i.e., there is no loss percentage.

By means of the method and the device in accordance with the invention, during the progress of the drying process, it is also possible to cool the material to be dried in between in order to obtain a better drying capacity. This is also permitted by the condition of the surrounding air (no risk of condensation).

When an arrangement in accordance with the present invention is used, a dryer section is obtained whose length is even just half the length of the dryer section in the prior art constructions. In the directions of height and width of the dryer section, the geometry of the dryer group can be constructed in accordance with the requirements of the wet end of the machine. Moreover, the arrangement in accordance with the invention does not require extensive investments, and it can also be used in modernizations of existing paper machines.

The arrangement in accordance with the invention is easy to operate, because the devices can be placed in a number of different ways so that, for example, the present, conventionally known tending platform is employed. All points of discontinuity, such as group gaps, are placed at viewing height from the tending platform.

The running and the mode of drying in accordance with the invention permit the use of rolls of large diameter and even rolls of different diameters in one group. They permit a machine geometry in which the runnability can be improved and the machine speed be increased further.

Since blowing from the drum is needed during drying only, the auxiliary operations (such as threading) can be carried out without blowing of gas or heating. In this manner, the consumption of energy is minimized and the external conditions are improved.

The rolls have common or individual drives. An individual drive of a roll permits a circumferential speed of the roll different from the speed of the web. This possibility prevents, for example, blow marking.

In the arrangement in accordance with the invention, no closed hood is needed in which case the accessibility during operation of the paper machine is better than in the prior art constructions.

In the invention, a pervious or impervious wire is used. Likewise, the wire may be heat-conductive or non-conductive. The range of the material to be dried may vary from the thickest board grades to thinner printing papers, tissue paper, or any material whatsoever to be dried that can be bent around the drum.

Even if, in the present description, the method and the device in accordance with the invention are described mainly as applied to the dryer section of a paper machine, it is understood that the invention is also suitable for drying applications of other types, such as drying a coating on a paper or equivalent, in which, at the side of the coating, there must be a contact-free draw, and, for example, drying of felts or equivalent, drying of various web-like materials from the thickest board grades to the thinnest printing paper, the only limitation being the flexibility of the material to be dried.

BRIEF DESCRIPTION OF THE DRAWINGS

The following drawings are illustrative of embodiments of the invention and are not meant to limit the scope of the invention as encompassed by the claims.

FIG. 1A is a cross-sectional view of the device in accordance with the invention and used in the method in accordance with the invention.

FIG. 1B is a sectional view of the device in accordance with the invention in the longitudinal direction.

FIGS. 4A and 4B are schematic longitudinal sectional views of exemplifying embodiments of wire guides for use in connection with the device of the invention.

DETAILED DESCRIPTION OF THE INVENTION

Figure 2A:
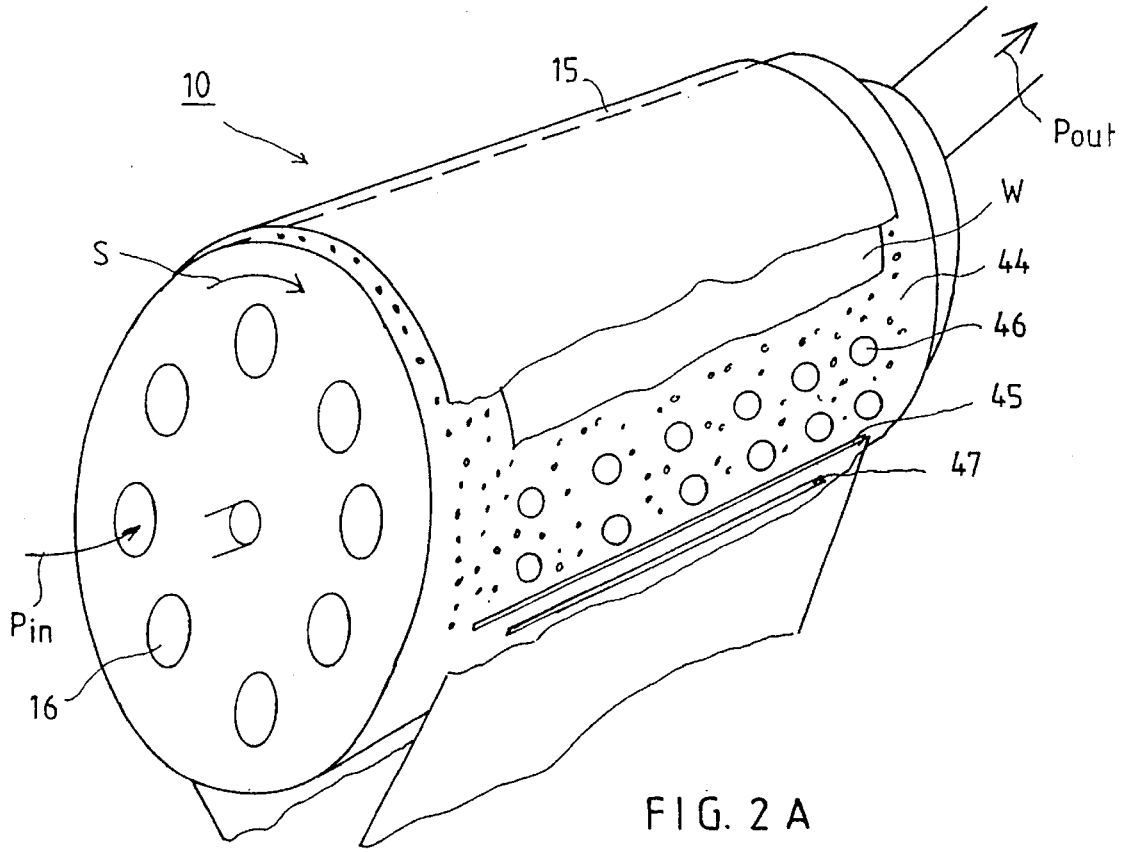
FIG. 2A is an axonometric view of the device in accordance with the invention.

The device in accordance with the invention that is shown in FIGS. 1A and 1B includes a roll 10, cylinder, drum, or equivalent, having a mantle 12 provided with holes 44,46. Into an interior of the roll 10, a drying gas $P_{in}$ is passed, which is blown through the holes 44 onto the face of a material W to be dried, such as paper. Since the paper W is supported by a wire 15, a pressure is produced between the outer face of the roll 10 and the paper W. By means of a suitable compression pressure, the paper W is separated from the face of the roll 10 which permits a flow of the drying gas, which is usually heated air, from the inlet holes 44 into the outlet holes 46, and the drying process proper is carried out. With a suitable blow pressure, which depends on the force applied by the wire 15 to the paper W, i.e., on the wire tension, a support zone formed by pressurized gas, a so-called air cushion 11, is produced between the outer face of the roll 10 and the paper W supported by the wire 15, which air cushion supports and dries the paper W. The gas/air that is blown is dry and heated and, thus, binds humidity. The blow pressure is from about 500 Pa to about 10,000 Pa, preferably from about 1000 Pa to about 5000 Pa, and the temperature of the drying gas is from about 20° C. to about 500° C., preferably from about 100° C. to about 400° C. The humid gas is removed from the support zone 11 through the outlet holes 46 placed between the blow holes 44. The blow holes 44 extend almost across the entire width of the paper W, but the suction holes do not, because a control of the lateral areas of the paper W requires an outflow $P_Z$ between the roll 10 face and the paper W in this exemplifying embodiment of the invention. The rest of the roll 10 face, except the gas flow openings 44,46, may be smooth or grooved. The grooves may be placed in the longitudinal direction or in the cross direction of the roll 10 mantle, or between these directions, i.e., diagonal. The grooves may also be radial in relation to the blow or exhaust openings 44,46.

The drying gas $P_{in}$ is passed through the system of ducts 13 through the holes 44 in the face of the roll 10 mantle 12 into the zone between the outer face of the roll 10 and the paper W, in which zone an air cushion 11 is formed. Since there are no exhaust holes 46 in the end area $A_S$ of the roll mantle, the exhaust air $P_Z$ is discharged out of the gap between the roll 10 face and the paper W into a stationary outlet 35. In a middle area $A_1$ of the roll 10 mantle 12, between the intake holes 44, there are exhaust holes 46, through which the gas that has bound the moisture of the paper W is removed along the system of exhaust ducts 14 to the interior of the roll 10 and from there further out as the exhaust gas $P_{out}$.

In FIGS. 1A and 1B and in the following figures, the arrows denote the flow direction of the gas flow unless otherwise stated.

The paper web W that is supported by the wire 15 is guided over the guide roll 61 onto the face of the drying roll 10. The roll revolves in the sense indicated by the arrow S and, after the paper W has passed, on support of the wire 15, around the substantial circumferential area of the roll 10, it is passed by means of the other guide roll away from the roll face to further drying or to finishing operations. The area that is not covered by the web W, i.e., the gap between the inlet and outlet of the web over the roll 10, is substantially closed by means of a closing member 25.

The roll 10 revolves at a speed substantially equivalent to the running speed of the paper web and the wire. In some exemplifying embodiments of the invention, after the air cushion 11 has been formed, the speed of rotation of the roll can be slowed, and the rotation of the roll 10 can be even stopped.

Figure 2B:
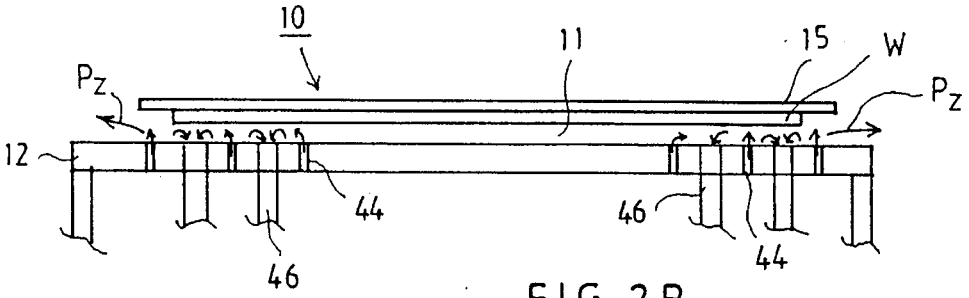
FIG. 2B is a longitudinal partial sectional view that illustrates the arrangement in accordance with the invention.

In the exemplifying embodiment of the invention as shown in FIGS. 2A and 2B, the supply $P_{in}$ of the drying gas into the roll 10 is accomplished through openings 16 placed at the ends of the roll 10, two different exemplifying embodiments of these openings being illustrated in FIGS. 4A and 4B. In FIG. 2A, for the sake of example, a slot-shaped blow opening 45 and a slot-shaped exhaust opening 47 are also shown. When the roll 10 revolves in the direction indicated by the arrow S, the drying gas that was passed in through the feed openings 16 is blown out through the roll 10 face through the blow holes 44 or blow slots 45, in which case a support zone, the so-called air cushion 11, consisting of pressurized gas is formed between the paper W and the outer face of the roll 10. From the air cushion, the gas humidified by the moisture of the paper W is removed through the exhaust holes 46 or exhaust slots 47 into the roll 10 interior, from where it is passed to the outlet as exhaust gas $P_{out}$. As is the case in the exemplifying embodiment of the invention as shown in FIGS. 1A and 1B, there are no exhaust holes 46 in the lateral areas of the roll 10 mantle 12, or the exhaust slot 47 has been formed substantially shorter in the lateral areas, in which case a part of the gas is removed as the exhaust $P_Z$ out of the lateral areas of the roll 10.

FIG. 2B is a schematic longitudinal sectional view of the roll 10. As shown therein, below the wire 15, there is the paper web W, below which an air-cushion zone of about 0.5 to about 10 mm, preferably from about 2 to about 4 mm, is formed. The diameter of the blow holes 44 in the roll 10 mantle 12 is about 1.0 to about 10 mm, preferably 2 to about 5 mm, and the diameter of the exhaust-air holes is about 10 to about 100 mm, preferably 20 to about 60 mm. When slot-shaped blow openings are used, their length is substantially equal to the width of the paper web, and their width is from about 1.0 to about 20 mm, preferably 2.0 to about 6.0 mm, and the length of the slot-shaped exhaust openings is shorter than the width of the paper web, and their width is about 5.0 to about 50 mm, preferably 10.0 to about 25 mm. The diameter of the blow roll 10 is 0.5 to about 10.0 m, preferably 1.5 to about 6.0 m.

Figure 2C:
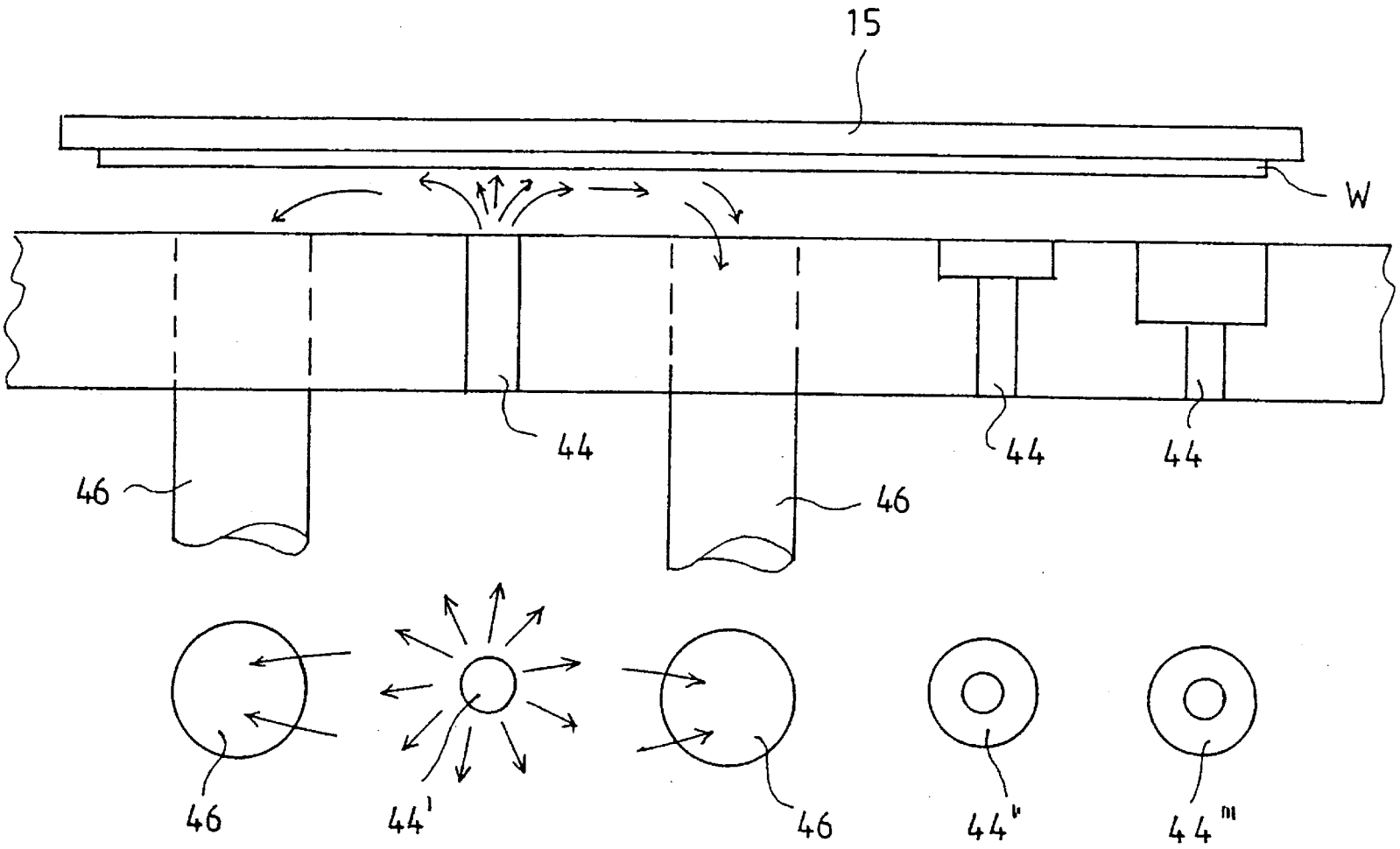
FIG. 2C shows exemplifying embodiments of blow openings for use in the device in accordance with the invention.

FIG. 2C illustrates the operation of a single blow hole 44. When the pressure of the air that is blown exceeds the tension force of the band 15 that supports the material W to be dried, the material to be dried is separated from the roll 10 face. A carrier-face zone, i.e. a so-called air cushion 11, is formed, whose thickness is about 0.5 to about 10 mm, preferably 1.5 to about 5 mm, and the gas can flow in the hole 44. Now the drying effect of the gas also starts. The gas collides against the material W to be dried at a velocity of about 30 to about 150 m/s, preferably 50 to about 120 m/s, and turns then so that it becomes parallel to the material W to be dried. During the entire flow of the gas, water is bound from the material W to be dried to the gas. This cooled gas of higher humidity is passed out through separate exhaust holes 46.

The dimensioning of the amount of gas to be blown is based on the consumption of blowing energy in comparison to the heat-transfer coefficient that is obtained. The optimal area of the holes is indicated as a percentage of the whole area of the roll 10 mantle 12. The values that are used are 0.2% to about 5%, preferably 0.5% to about 2.5%.

Attempts are always made to maximize the effective area (length on the circumference of the drum), but the other aspects of the runnability of the web W impose certain limitations on it. The covering angle is generally from about 180° to about 350°, preferably from about 250° to about 330°.

According to FIG. 2C, the blow openings in the roll 10 mantle 12 may be straight openings 44 or openings 44" or 44'" provided with a widening at some point in the radial direction.

The size of the opening for the inlet gas of the roll 10 and of the opening for the outlet gas, placed at the opposite end of the roll 10, as shown in FIGS. 1B and 2A, is selected so that the velocity of the gas at the opening is about 5 m/s to about 50 m/s, preferably 15 m/s to about 35 m/s.

Figure 3A:
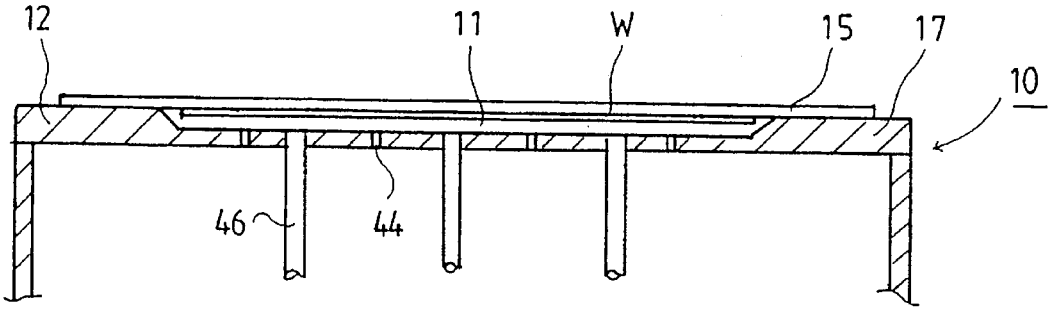
FIG. 3A is a partial sectional view of an exemplifying embodiment of the arrangement in accordance with the invention.
Figure 3B:
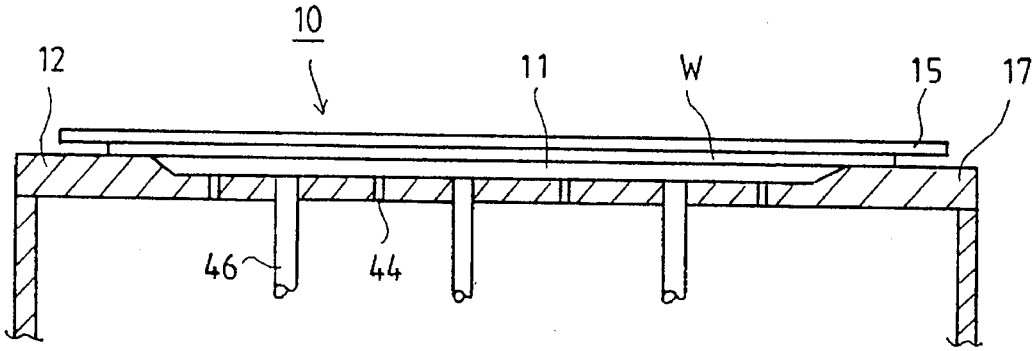
FIG. 3B is a longitudinal partial sectional view of a second exemplifying embodiment of the arrangement in accordance with the invention.

FIGS. 3A and 3B show exemplifying embodiments in which the effective part of the paper W and the wire 15 are supported by the air cushion 11, and the edges of the wire 15

(FIG. 3A) or the edges both of the paper W and of the wire 15 (FIG. 3B) are supported by the support faces 17 formed on the mantle part 12 of the blow roll 10. In these exemplifying embodiments, all the exhaust air is passed out of the area of the air cushion 11 through the exhaust openings 46.

FIGS. 2B, 3A and 3B illustrate the most important exemplifying embodiments of the invention: FIG. 2B shows a method in which a smooth roll face is employed over substantially the entire width of the web in which case a part of the gas is removed as the exhaust flow $P_Z$ from the lateral areas of the roll 10, where both the wire 15 and the paper W are completely supported by the air cushion 11; in the embodiment shown in FIG. 3A, the paper W is completely supported by the air cushion 11, but the wire 15 is supported on the support faces 17, and in FIG. 3B both the paper web W and the wire 15 are supported by the support faces 17.

According to FIGS. 4A and 4B, the blow air or gas is passed into the roll 10 through the duct 41 into the system of ducts 13 and further into the blow openings 44, and the humidified exhaust gas is passed through the system of ducts 14 to the exhaust 43 through the exhaust pipes or passages 46 out of the roll 10. In the exemplifying embodiment shown at the top in FIG. 4A, the wire 15 guide members 51 are attached to the ends in the lateral areas of the roll 10 mantle 12, and their positions are adjustable. At the bottom in FIG. 4A, the wire guides 52 have been formed as fixed in the lateral areas of the roll 10 mantle 12. At the top in FIG. 4B, there is a convex wire 15 guide face 23, and at the bottom a concave wire guide face 24. In this connection, it should be pointed out that the wire guides or guide faces should not be confused with the support faces described above.

Figure 5A:
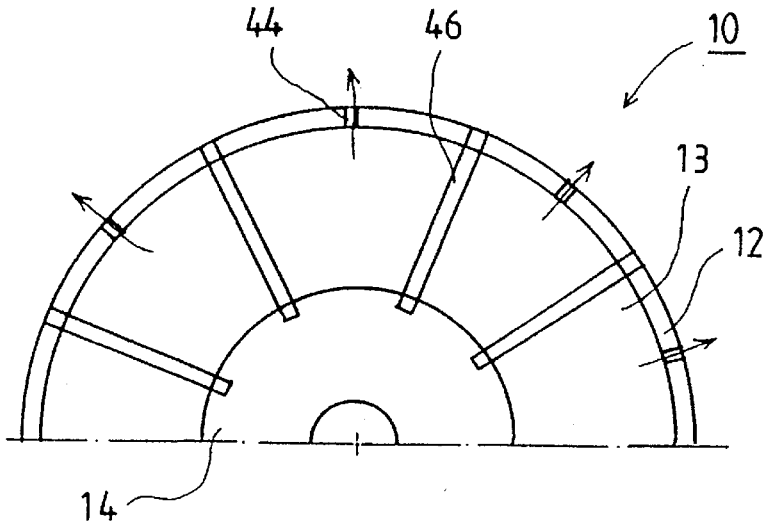
FIGS. 5A and 5B are schematic partial sectional views in the cross direction of the device in accordance with the invention.

FIG. 5A is a sectional view taken along the line A—A in FIG. 4A, wherein the system of air ducts 13 placed inside the roll 10 are shown, which ducts 13 pass into the blow openings 44, and the system of exhaust ducts 14, into which the humidified gas is passed through the exhaust openings 46.

Figure 5B:
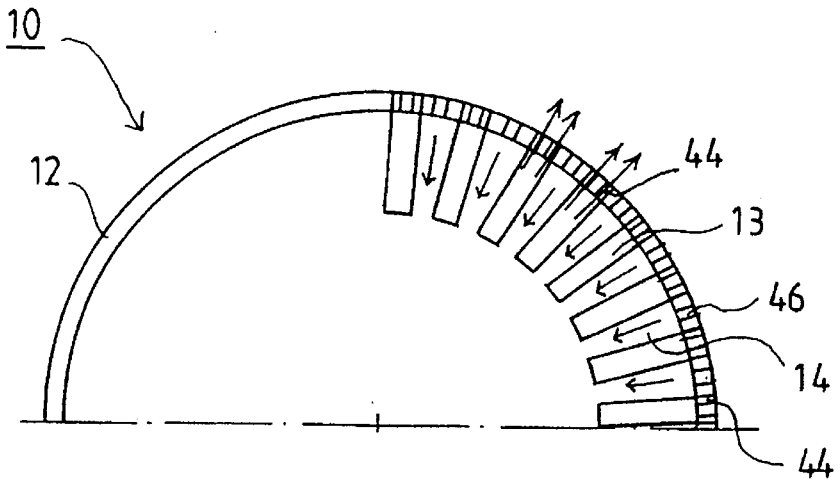

FIG. 5B is a sectional view taken along the line B—B in FIG. 4B, in which drying gas is passed out of the duct 13 through two blow openings 44 out through the roll 10 mantle face 12, and the humidified air is removed through the exhaust openings 46 to inside the roll 10 mantle face 12.

Figure 6A:
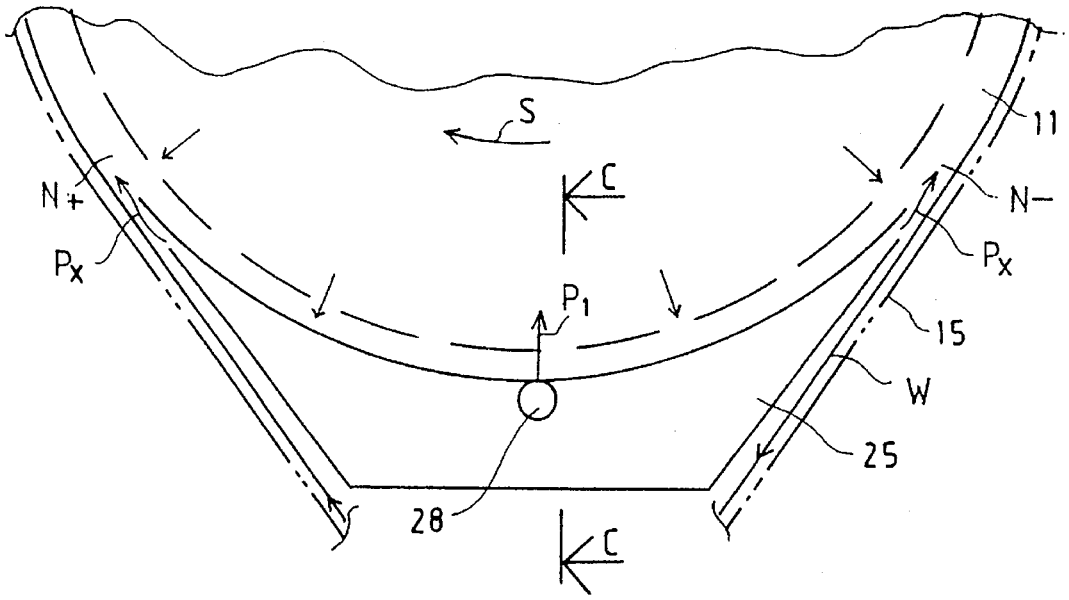
FIGS. 6A and 6B show a schematic exemplifying embodiment for covering the free area of the roll in the arrangement in accordance with the invention.
Figure 6B:
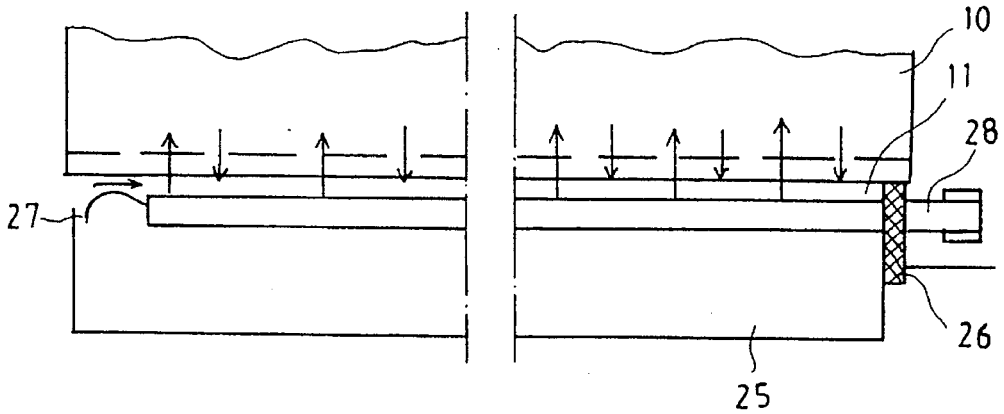

As shown in FIGS. 6A and 6B, the free portion of the blow roll 10, i.e., the area that remains outside the portion covered by the wire 15 and by the paper W, is closed by means of a closing member 25 so as to reduce leakage. The closing member 25 may be a separate device, such as shown in the figures, or the area is closed in the longitudinal direction between the reversing rolls 61 (FIG. 1) and in the cross direction by means of ends (not shown) formed by the blow roll 10 and the reversing rolls 61. The closing member 25 includes a sealing against the blow roll 10, which sealing is carried out by means of a mechanical seal 26 or by means of a sealing counter-blowing 27. In the sealing counter-blowing 27, blower air or compressor air is employed.

At the points of inlet and outlet of the material W to be dried onto and off the blow roll 10, there is counter-blowing $P_X$ in the pressure nip N+ at the inlet side of the web W and in the vacuum nip N− at the outlet side to prevent the air cushion 11 from being discharged. The counter-blowing device may be integrated, e.g., with the closing member 25, or it may be a separate device.

The cleaning of the blow roll 10 takes place by means of counter-blowing $P_1$ against the roll 10 face. For the blowing $P_1$, it is possible to use blower air or compressor air, and the cleaning equipment 28 may be placed in the closing member 25 or be a separate device.

Figure 7:
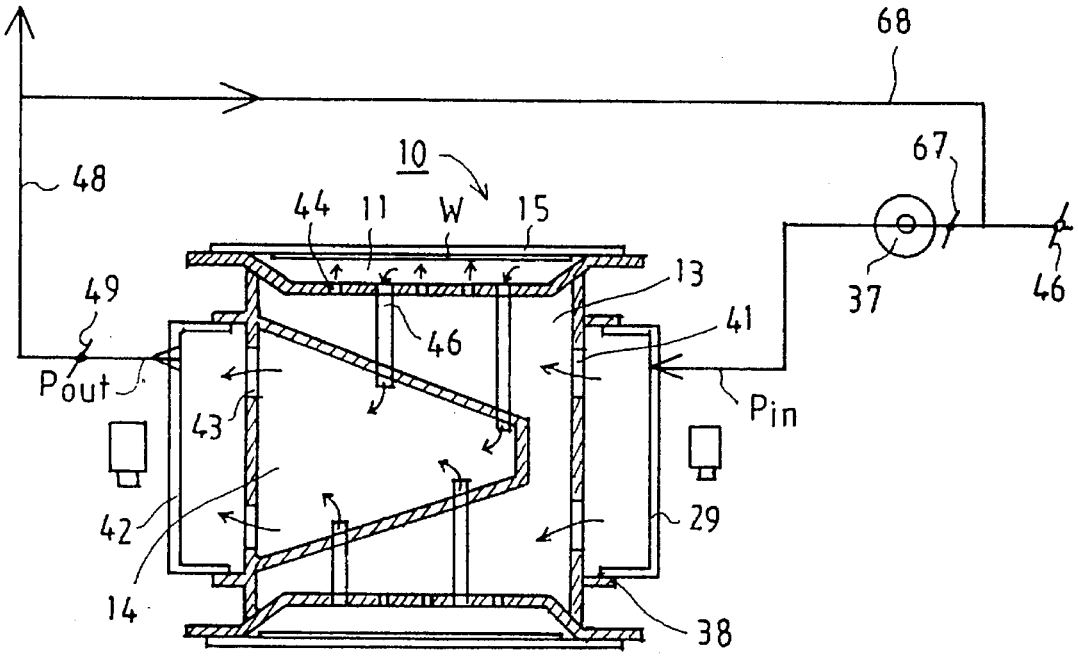
FIG. 7 shows a flow diagram of the drying gas.

FIG. 7 shows the flow diagram of the drying gas, such as heated air. Since the air-cushion principle requires that the drying gas is also pressurized at the discharge opening 46, the state of the entire gas of higher humidity that is discharged is pressurized. Thus, the entire interior of the revolving blow roll 10 and the gas distributor devices outside the roll are pressurized. The system requires just one blower system 37 to feed the gas. By regulating the blower system 37, the desired pressure state of the gas is obtained by means of a regulator 67, or the gas flow is obstructed at the discharge side by means of a regulator 49. The gas that is discharged can be passed, for example, through heat recovery to the open air, or a part of the gas can be recirculated to among the gas to be blown in.

In FIG. 7, the reference numeral 29 denotes the stationary gas distributor equipment, which is sealed in relation to the roll 10 by means of the seals 38. The gas flow is illustrated by means of arrows. The drying gas is passed into the drying-gas inlet 41 in the gas distributor equipment 29 of the roll, from which it is passed through the set of ducts 13 into the blow holes 44. The humidified gas, which is removed through the exhaust holes 46, is passed through the set of exhaust ducts 14 to the outlet 43, from which it is passed further through gas distributor equipment 42 to an outlet duct 48, which is provided with a regulation member 49. From outlet duct 48, the gas is passed to the open air or a part of the gas is recirculated to among the gas to be blown in, into a duct 68.

In the following FIGS. 8A–11R, different geometries of the dryer section with the use of the device 10 in accordance with the invention are illustrated. In the figures, the solid line represents the material W to be dried, which is usually paper, board or equivalent, the dashed line represents the blow roll 10 and the guide roll 61, which may be smooth, grooved, or a suction roll, and the dashed-dotted line represents the support band 15, which is most commonly a wire or equivalent.

FIGS. 8A–8D illustrate exemplifying embodiments in which twin-wire draw is employed. The upper wire is denoted by reference 15*y* and the lower wire is denoted by reference 15*a*. The wire guide rolls are denoted by reference numeral 61. The closing member of the free portion of the roll 10 is denoted by reference numeral 25.

Figure 8A:
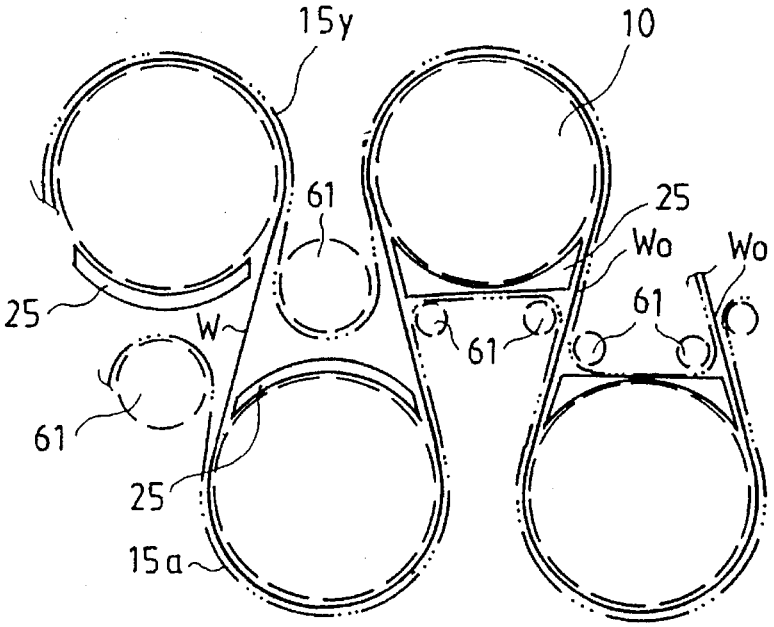
FIGS. 8A–11R illustrate different geometries in which the device in accordance with the invention is applied.

In FIG. 8A, in connection with the roll 10, one intermediate roll 61 is arranged in the embodiment shown at the left, and two intermediate rolls 61 are arranged in the embodiment shown to the right. When two intermediate rolls 61 are employed, a better support of the paper W is obtained over the free gap $W_O$.

Figure 8B:
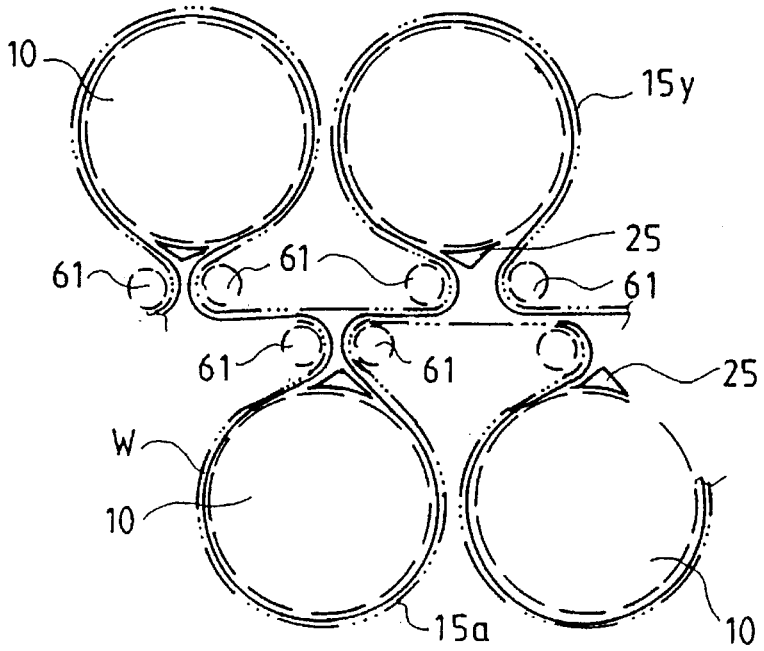

In the embodiment of FIG. 8B, the effective blow area of the blow roll 10 has been maximized, in which case a closing member 25 is needed in a small area only, and a greater number of blow rolls 10 can be placed in the same wire group. The group has a closed draw, i.e., the paper W is constantly supported by a wire 15*a*, 15*y*.

Figure 8C:
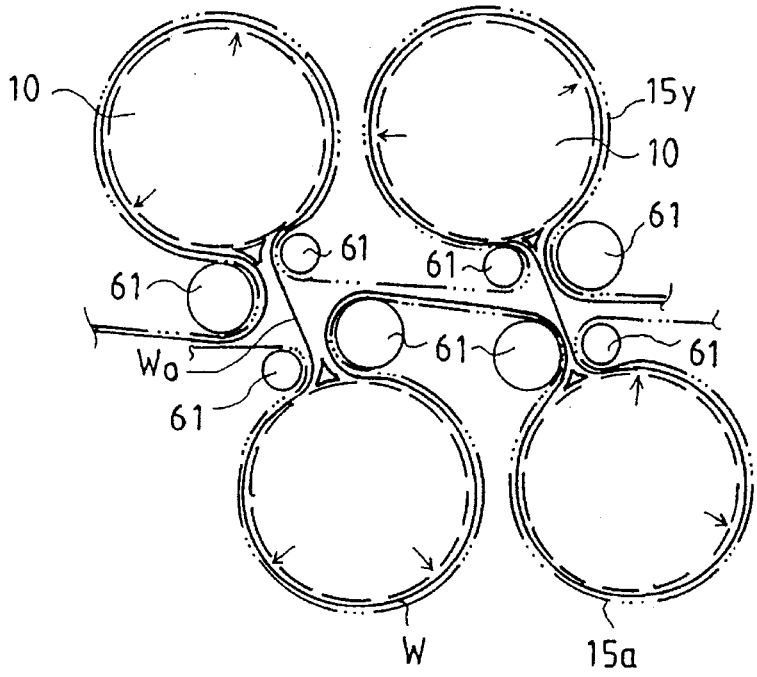

FIG. 8C shows an embodiment that is substantially similar to the embodiment shown in FIG. 8B, but an open draw is employed, in which the paper W is transferred from one blow roll 10 onto the 10 other without a wire, as open draws $W_O$.

Figure 8D:
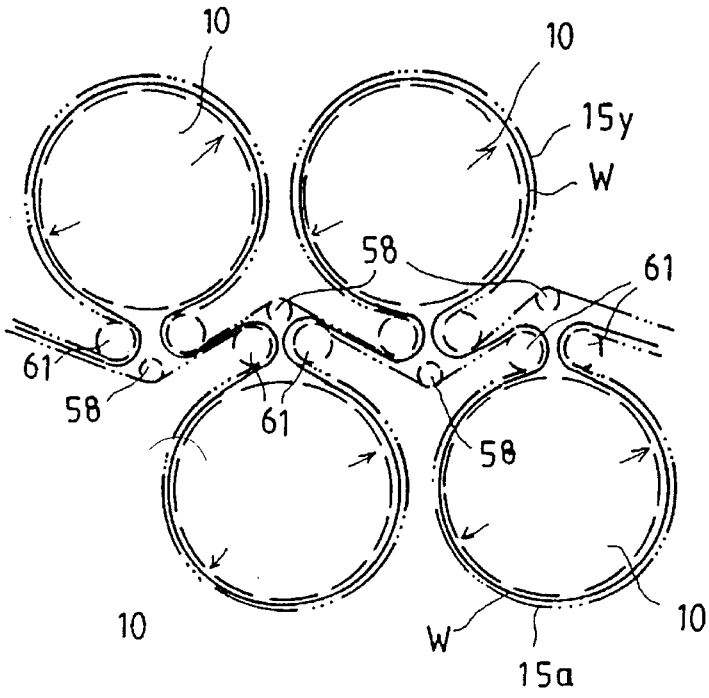

FIG. 8D shows a twin-wire draw in which the effective blowing of the blow roll 10 has been maximized and in which a greater number of blow rolls 10 can be arranged in the same wire group. A closed draw is employed, and a geometry of low height is obtained, because the blow rolls 10 are placed close to one another in the vertical direction.

In addition to the intermediate rolls 61, in order to guide the wire 15*a*, 15*y*, auxiliary rolls 58 are employed.

Figure 9A:
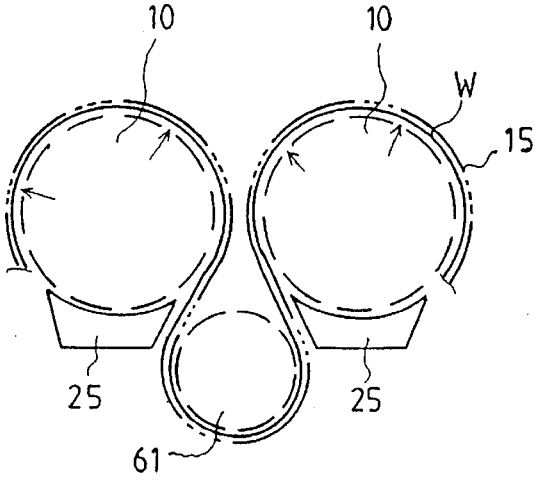

FIG. 9A shows an embodiment in which, in single-wire draw, one intermediate roll 20 61 is arranged in connection with the roll 10.

Figure 9B:
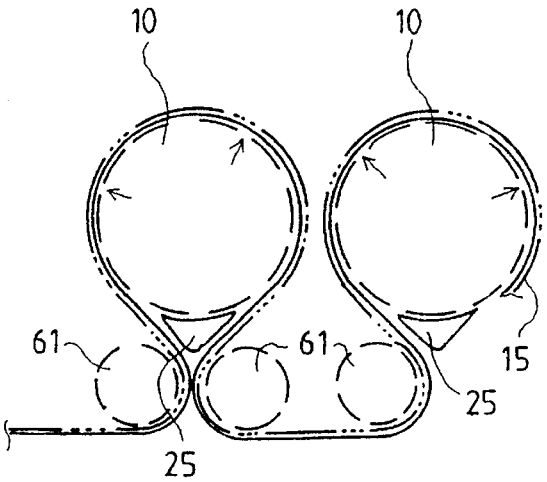

FIG. 9B shows an embodiment in which, in single-wire draw, there are two intermediate rolls 61 in connection with the roll 10, by whose means a large coverage of the blow roll 10 is obtained.

Figure 9C:
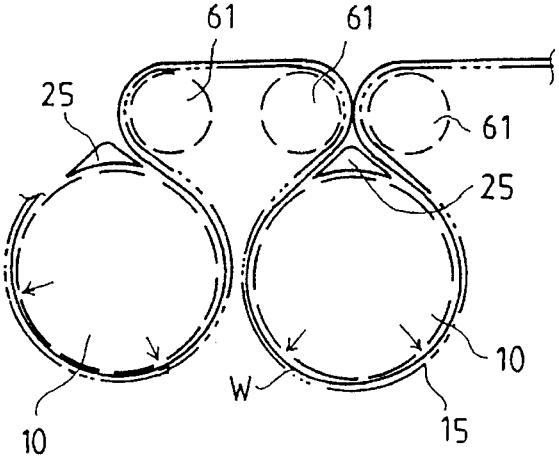

FIG. 9C shows an inverted arrangement with single-wire draw, in which, in connection with the blow roll 10, the wire 15 is guided by two intermediate rolls 61, in which arrangement an advantage is the large coverage of the blow roll.

Figure 9D:
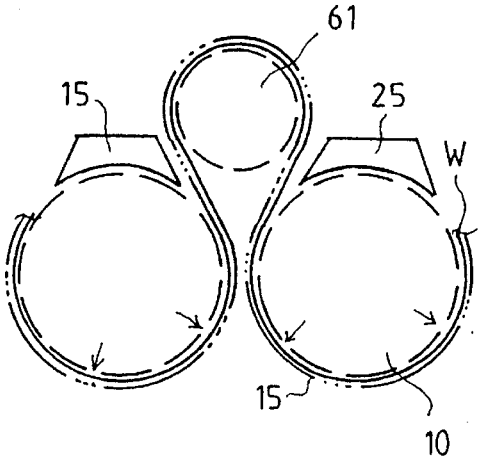

FIG. 9D shows an inverted arrangement with single-wire draw, in which the wire 15 is guided by one intermediate roll 61 arranged as interlocked between the blow rolls 10.

It is a feature common of the exemplifying embodiments shown in FIGS. 10A–10D that single-wire draw is used and the web W is passed from one blow roll 10 to another blow roll 10. Depending on the geometry, either in connection with the upper blow rolls 10 or in connection with the lower blow rolls 10, the support band or wire 15 is the member that receives the blowing. For this reason, the band 15 should preferably be capable of conducting heat, in which case the drying or cooling effect is transferred to the paper W by the intermediate of the band 15, and, in order that it could be secured that the material to be dried remains in contact with the band, the band is preferably impenetrable by air. This mode of running may also be employed with such materials to be dried as require an adequate contact with the support band both in the longitudinal direction of the web and in the cross direction so as to guarantee the quality or equivalent.

Figure 10A:
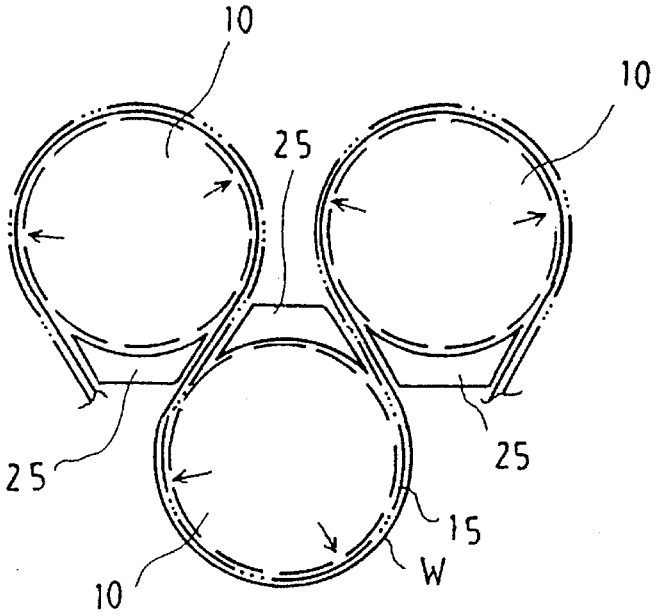

In the exemplifying embodiment shown in FIG. 10A, supported by the wire or the band 15, the web W is passed from the blow roll 10 of the upper row onto the blow roll 10 of the lower row and so forth. In the lower row, the paper web W is placed outside. By means of this construction, a low geometry is obtained, but the coverage by the web W is not very wide.

Figure 10B:
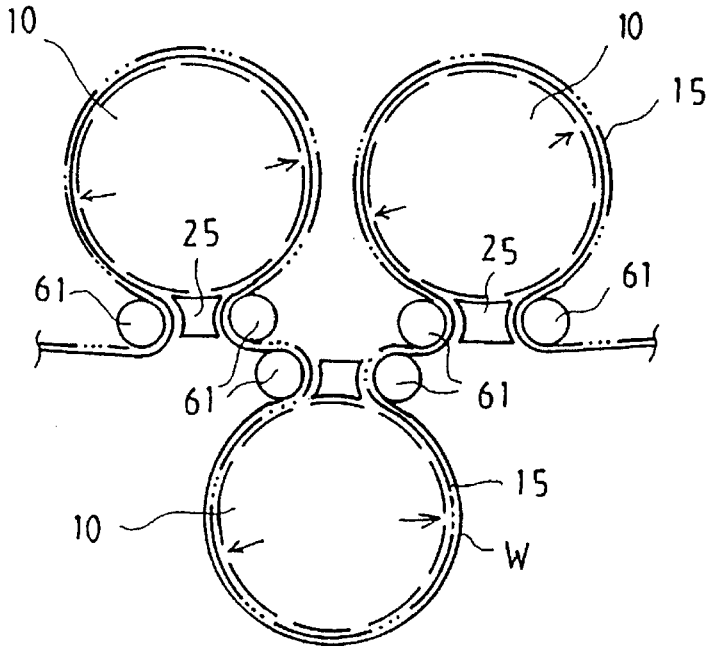

In FIG. 10B, an exemplifying embodiment based on a geometry with single-wire draw is shown, in which, in order to increase the coverage proportion and to guide the band or the wire 15, intermediate rolls 61 are employed. On the blow roll 10 in the lower row, the paper web W is placed outside. By means of this construction, a good coverage but a rather high geometry are obtained.

Figure 10C:
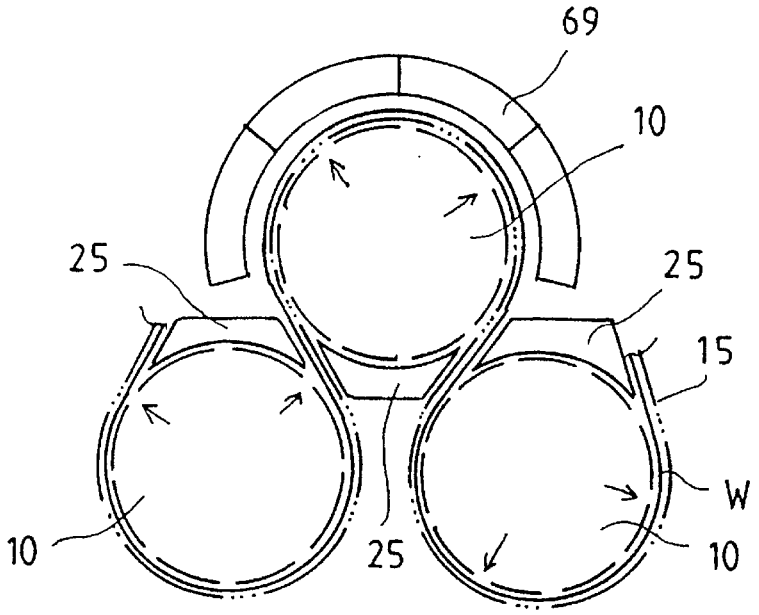
Figure 10D:
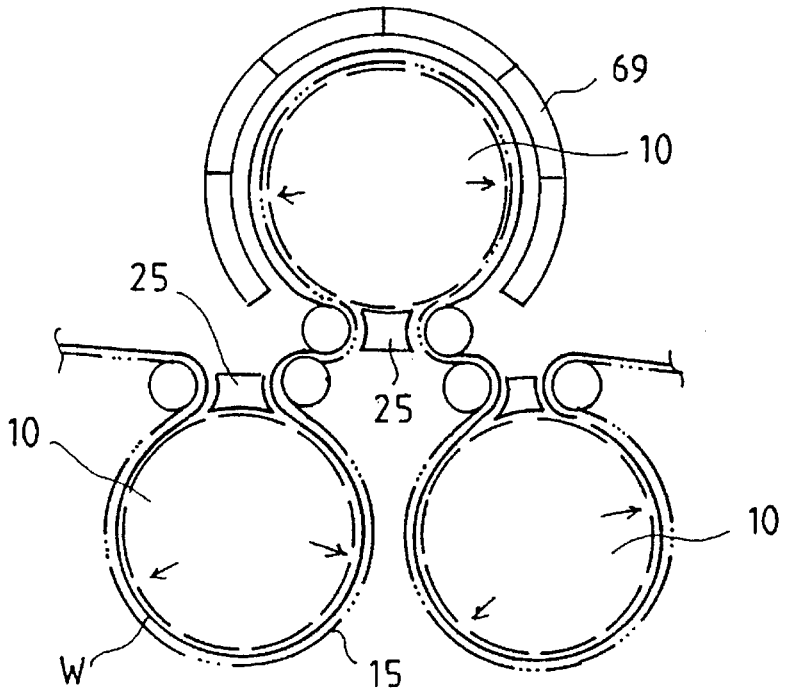

In the exemplifying embodiments shown in FIGS. 10C and 10D, in respect of the paper placed outside on the blow rolls 10 in the upper row, a device 69 is used that applies a normal stationary drying technique, for example infrared drying, blowing or equivalent or cooling, and, if necessary, such a device can also be employed in the other exemplifying embodiments shown in the figures. In the other respects, the embodiments shown in FIGS. 10C and 10D are similar to those shown in FIGS. 10A and 10B, even if, in them the paper web W is outside on the upper-row blow roll.

Figure 13:
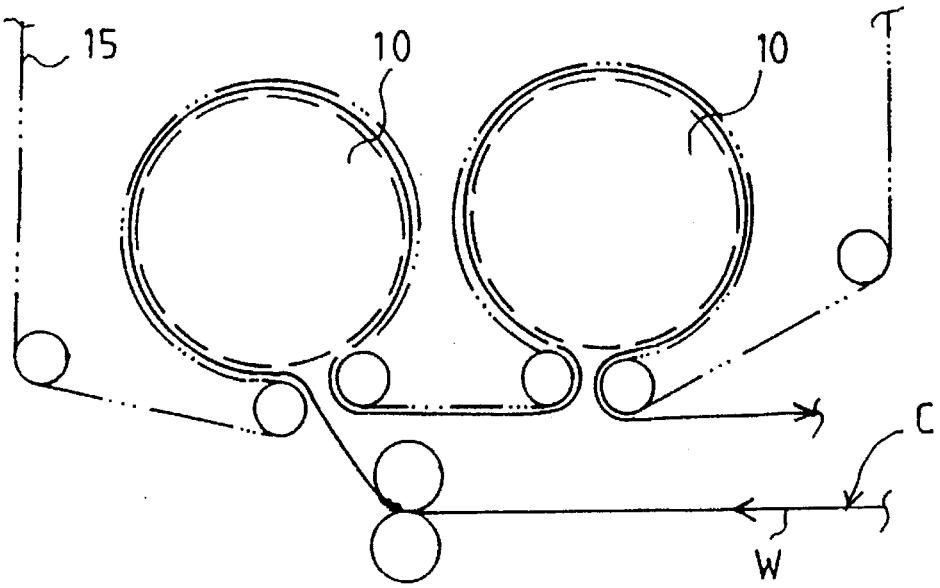
FIG. 13 shows still another exemplifying embodiment of the invention.

The blow roll in accordance with the invention is well suitable for the drying of a coating on paper or equivalent, in which case it is desirable to use so-called contact-free drying at the side to be dried (FIG. 13). Drying by means of a blow roll can also be applied to the current steam-heated cylinder geometries, and stationary heating can be carried out, for example, by means of blow, infrared, or equivalent separate devices, which can be applied to all the geometries illustrated in the following FIGS. 11A–11R, in which the rolls in the dryer group arrangements in themselves known are denoted with the reference numeral 73.

Figure 11A:
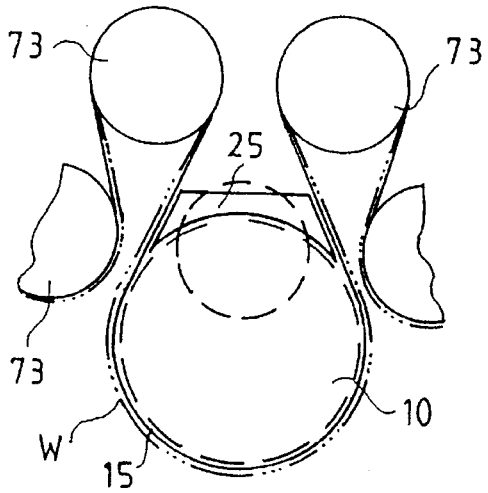

FIG. 11A shows an embodiment with single-wire draw, in which the wire 15 supports the web W that runs over the blow roll 10. The effective blow angle of the blow roll 10 is the same as with the other cylinders 73.

Figure 11B:
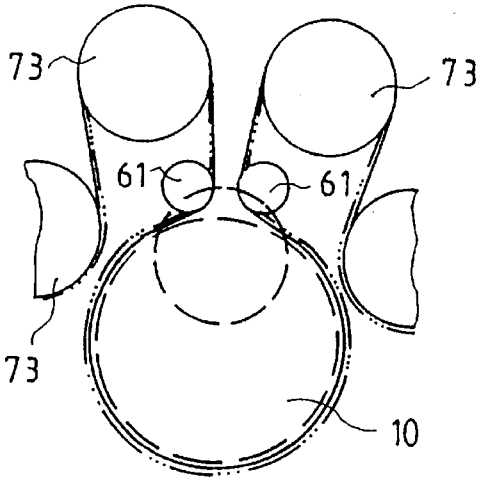

FIG. 11B shows a single-wire draw in which the wire 15 guides the web W over the 15 blow roll 10, in connection with which two intermediate rolls 61 are arranged. The effective blow angle of the blow roll 10 has been maximized.

Figure 11C:
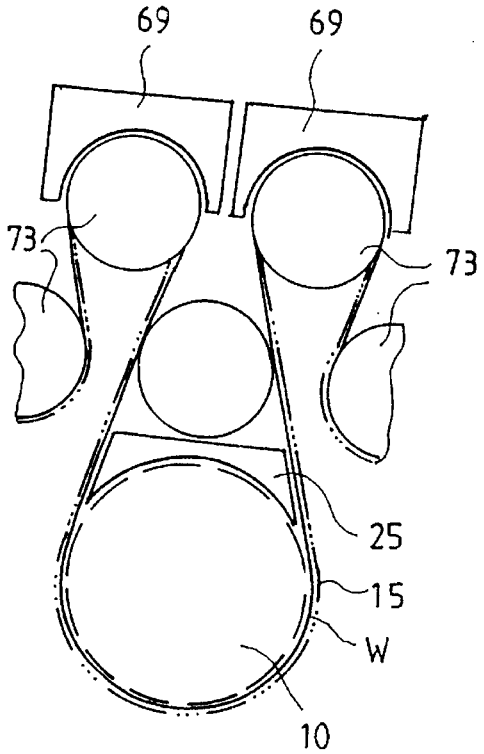

In the embodiment with single-wire draw shown in FIG. 11C, a stationary dryer device 69 is also used. The effective blow angle of the blow roll 10 is the same as that of the cylinders 73.

Figure 11D:
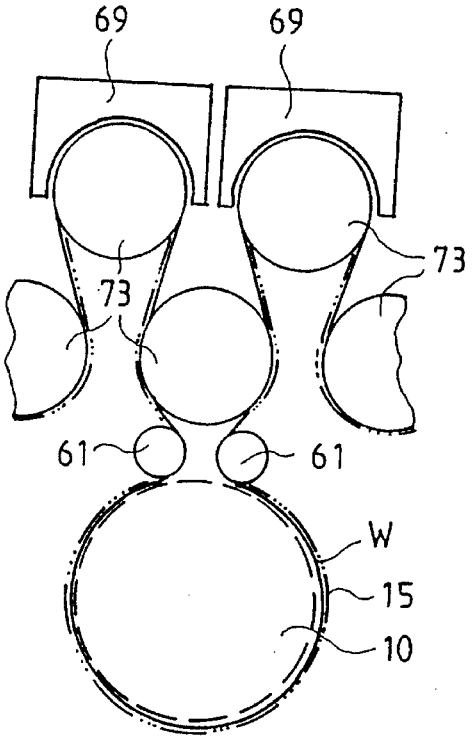

In the embodiment with single-wire draw shown in FIG. 11D, the effective blow angle has been maximized.

Figure 11E:
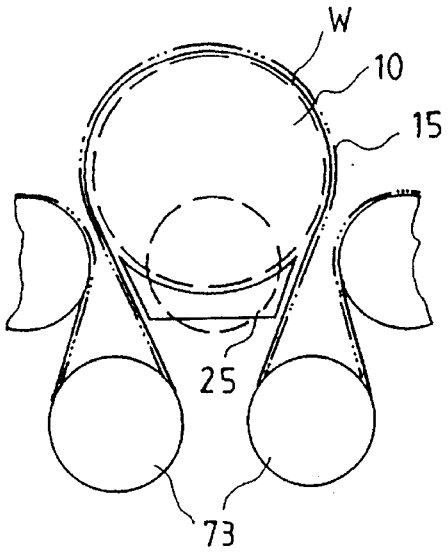

FIG. 11E shows an embodiment inverted in comparison to that shown in FIG. 11A.

Figure 11F:
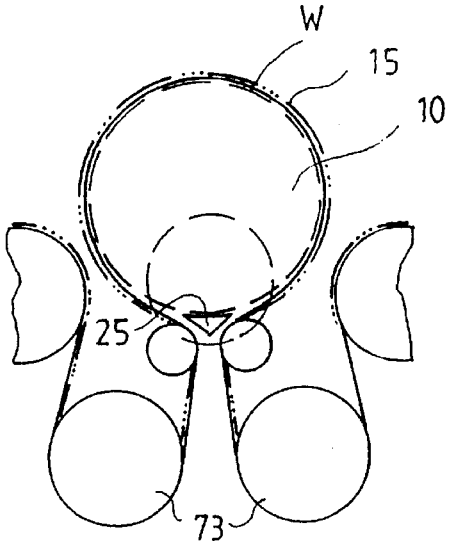

The embodiment shown in FIG. 11F is similar to that shown in FIG. 11B but inverted.

Figure 11G:
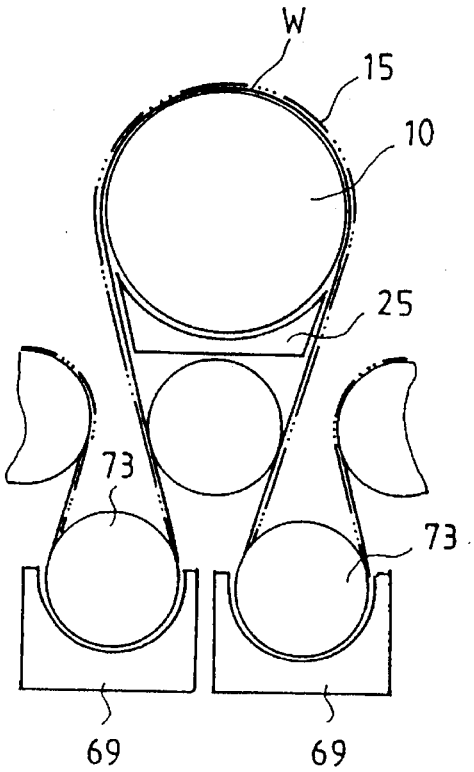

The embodiment shown in FIG. 11G is similar to FIG. 11C but in an inverted arrangement.

Figure 11H:
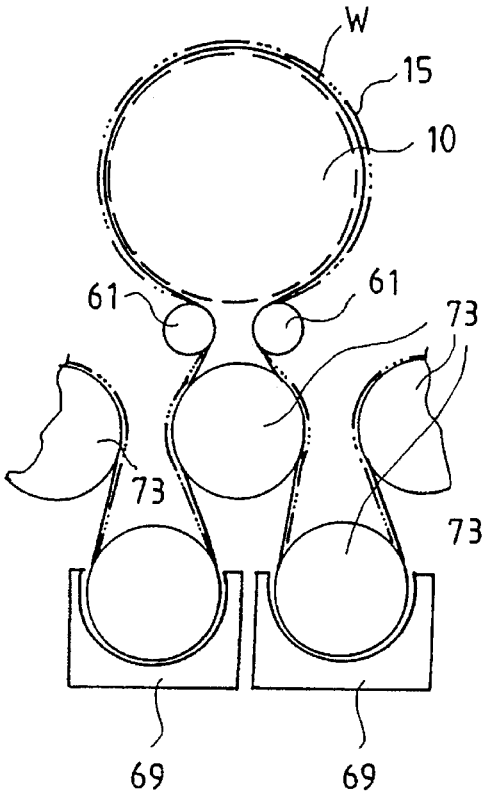

The embodiment shown in FIG. 11H shows an inverted arrangement corresponding to that of FIG. 11D.

Figure 11I:
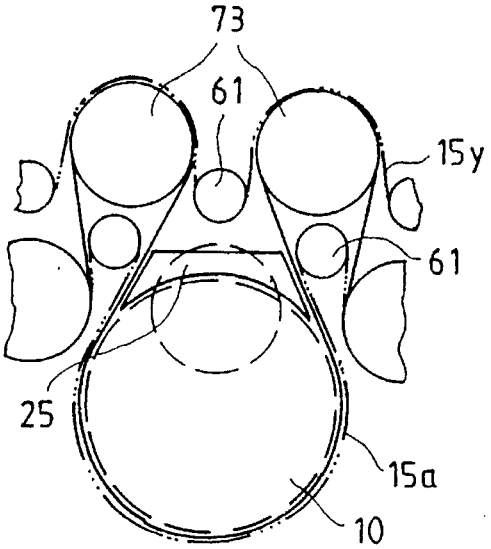

FIG. 11I shows an embodiment with twin-wire draw in which the effective blow angle of the blow roll 10 is the same as with the other cylinders 73.

Figure 11J:
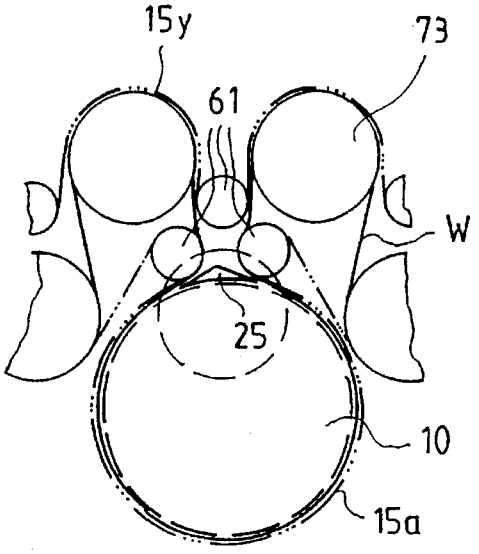

FIG. 11J shows an embodiment with twin-wire draw in which the effective blow angle of the blow roll 10 has been maximized.

Figure 11K:
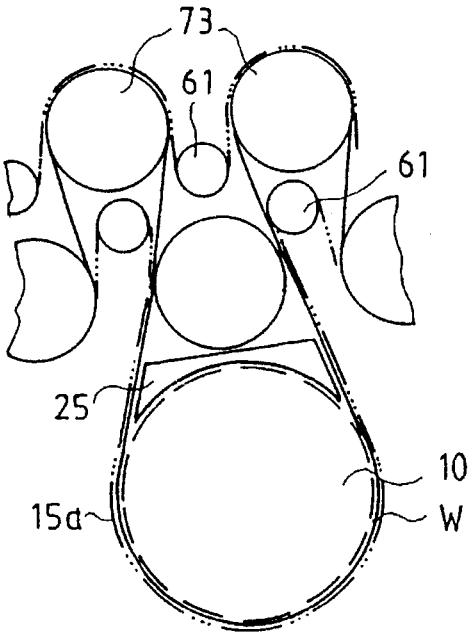

FIG. 11K shows an embodiment with twin-wire draw in which the effective blow angle of the blow roll is the same as with the other cylinders.

Figure 11L:
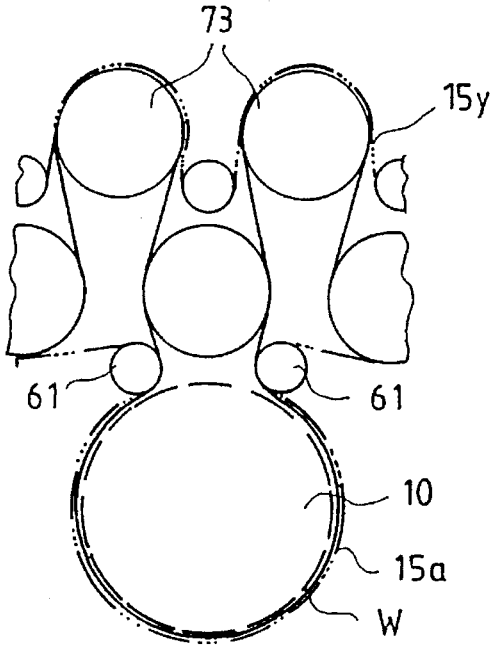

In the embodiment with twin-wire draw shown in FIG. 11L, the effective blow angle of the blow roll 10 has been maximized.

Figure 11M:
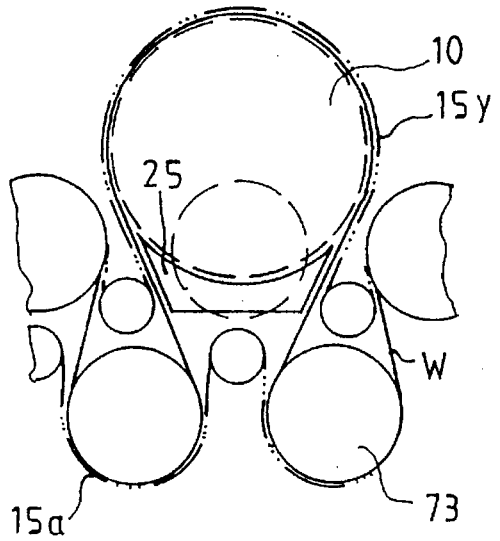

In the embodiment with twin-wire draw shown in FIG. 11M, the blow roll 10 is placed in the upper row of cylinders, the rest being similar to FIG. 11I.

Figure 11N:
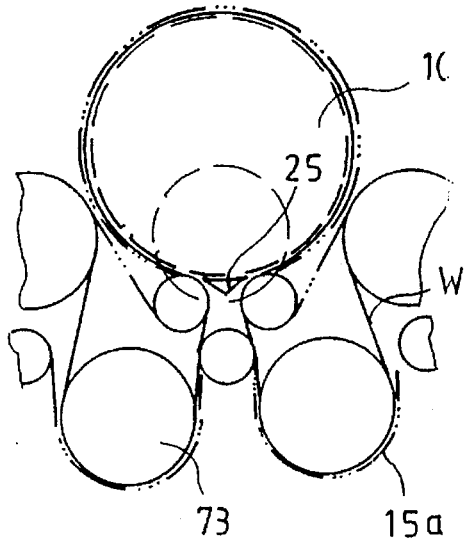

In the embodiment with twin-wire draw shown in FIG. 11N, the blow roll 10 is placed in the upper row of cylinders, the rest being similar to FIG. 11J.

Figure 11O:
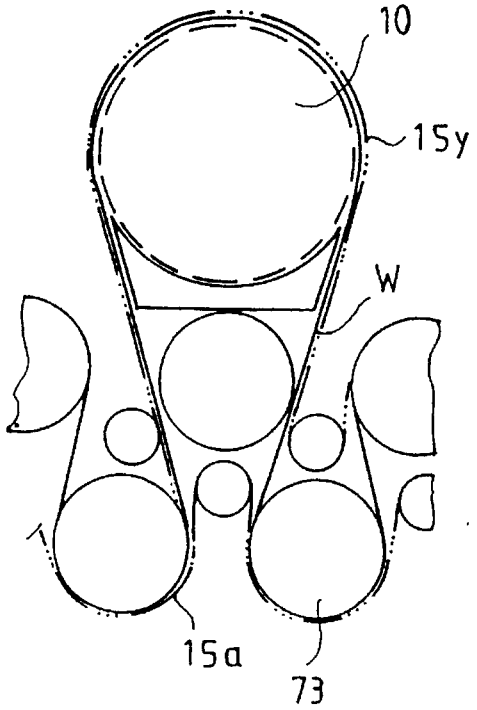

In the embodiment with twin-wire draw shown in FIG. 11O, the blow roll 10 is placed in the upper row of cylinders, the rest being similar to FIG. 11K.

Figure 11P:
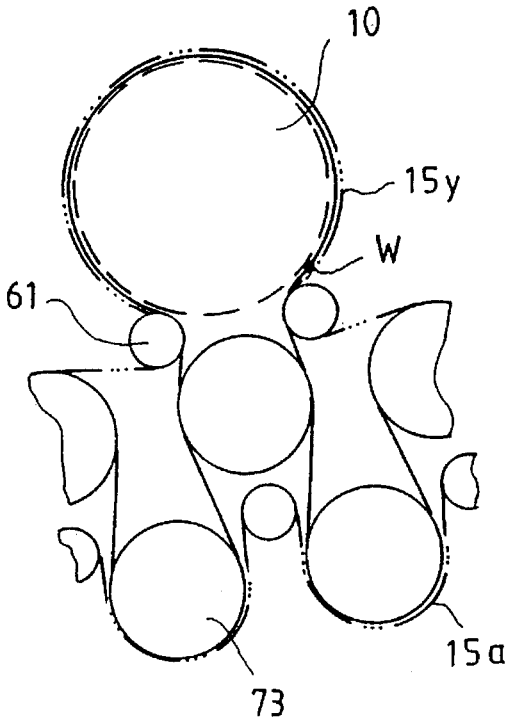

FIG. 11P corresponds to FIG. 11L as an embodiment with twin-wire draw, the blow roll 10 being placed in the upper row.

FIG. 11Q illustrates an application to a prior art existing dryer section in which steam-heated drying cylinders 73 are used. The figure shows an embodiment with twin-wire draw, in which an upper wire 15*y* and a lower wire 15*a* are employed, and the arrangement in accordance with the present invention has been accomplished in connection with the lower wire 15*a*, where a blow roll 10 in accordance with the invention is placed, which roll 10 is preferably placed in the place of the first or last cylinder in a normal dryer group.

FIG. 11R shows an embodiment corresponding to FIG. 11Q, in which the blow roll 10 is placed in connection with the upper wire 15*y*.

One blow roll 10 can also form a group of its own. In the dryer section, there may be several such groups, either with an upper wire or with a lower wire.

Figure 12:
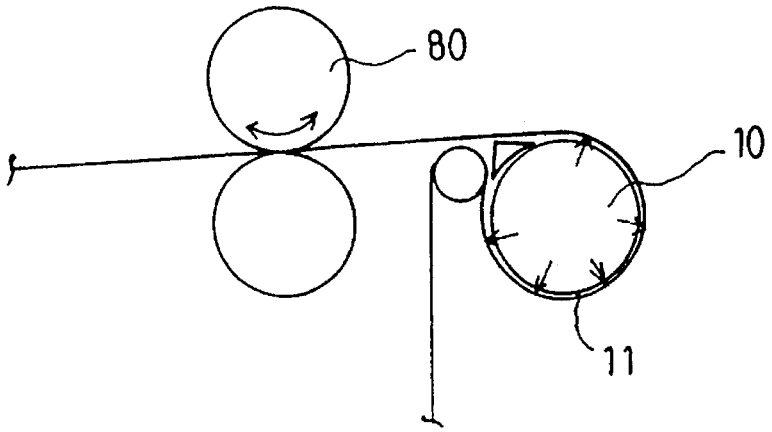
FIG. 12 shows another exemplifying embodiment of the invention.

As shown in FIG. 12, a blow roll 10 in accordance with the invention may also be used for the drying of various felts and equivalent materials. As an example therefor, it should be mentioned the press felts of paper machines that are used currently. In the drying, it is unimportant if the felt 80 to be dried is pervious to air or impervious, nor is the thermal conductivity of the felt of decisive importance. With a felt penetrable by air, the drying takes place partly as through blowing. The rest of the drying, like the drying of paper, takes place by the air-cushion principle provided by means of a roll 10 in accordance with the invention.

FIG. 13 shows an embodiment in which an arrangement in accordance with the invention is used in the drying of a coated paper web W or equivalent. A coated side C of the paper web W runs as a contact-free draw over the blow rolls 10 on support of the wire 15 and carried by the air cushion 11.

The examples provided above are not meant to be exclusive. Many other variations of the present invention would be obvious to those skilled in the art, and are contemplated to be within the scope of the appended claims.

I claim:

1. A method for drying and/or cooling a paper web by means of a gas, comprising the steps of:

carrying the web on support of a wire over a circumference of a revolving roll on a face of the wire facing the roll, blowing a gas through a first set of openings in a mantle of the roll into a space between an outer face of the roll and the web to form a support zone between the outer face of the roll and the web whereupon the gas becomes humidified as the web is dried, directing the humidified gas from the support zone into an interior of the roll through a second set of openings in the roll mantle of the roll, and exhausting the humidified gas from the interior of the roll.

2. The method of claim 1, further comprising the step of passing the web on support of the wire to maintain the web at a distance from a face of the roll mantle.

3. The method of claim 1, further comprising the step of forming a thin support zone between the web and the outer face of the roll having a thickness from about 0.5 mm to about 10 mm.

4. The method of claim 1, further comprising the step of producing the support zone between the outer face of the roll and the web by means of the counter-force of the tension of the wire.

5. The method of claim 1, further comprising the step of determining the velocity at which the web runs over the circumference of the roll based on the velocity of the wire.

6. The method of claim 1, further comprising the step of rotating the roll at a different velocity than the velocity of the wire carrying the web over the roll.

7. The method of claim 1, wherein the wire is a thermally conductive support wire that is impenetrable by gas, further comprising the step of heating the support wire such that the heat of the support wire is transferred to the web through contact therewith.

8. The method of claim 1, wherein the web is carried on support of a wire over all but a small portion of the circumference of the revolving roll, further comprising the step of sealing the small portion of the circumference of the roll to prevent the support zone from being discharged.

9. A method for drying and/or cooling a felt by means of a gas, comprising the steps of:

carrying the felt on support of a wire over a circumference of a revolving roll on a face of the wire facing the roll, blowing a gas through a first set of openings in a mantle of the roll into a space between an outer face of the roll and the felt to form a support zone between the outer face of the roll and the felt whereupon the gas becomes humidified as the web is dried, directing the gas from the support zone into an interior of the roll through a second set of openings in the roll mantle of the roll into a system of exhaust ducts situated inside the roll, and exhausting the humidified gas from the interior of the roll.

* * * * *